US007481942B2

(12) United States Patent
Min et al.

(10) Patent No.: US 7,481,942 B2
(45) Date of Patent: Jan. 27, 2009

(54) MONOLITHIC INK-JET PRINTHEAD AND METHOD OF MANUFACTURING THE SAME

(75) Inventors: Jae-sik Min, Gyeonggi-do (KR); Byung-ha Park, Gyeonggi-do (KR); Myung-jong Kwon, Gyeonggi-do (KR); Young-shik Park, Gyeonggi-do (KR); Yun-gi Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 324 days.

(21) Appl. No.: 10/422,824

(22) Filed: Apr. 25, 2003

(65) Prior Publication Data

US 2004/0035823 A1 Feb. 26, 2004

(30) Foreign Application Priority Data

Aug. 26, 2002 (KR) ..... 10-2002-0050527

(51) Int. Cl.
*B41J 2/135* (2006.01)

(52) U.S. Cl. ..... 216/27; 216/41; 216/49; 430/312; 430/320

(58) Field of Classification Search ..... None
See application file for complete search history.

(56) References Cited

U.S. PATENT DOCUMENTS 3,884,698 A * 5/1975 Kakihama et al. ..... 430/510
4,666,823 A * 5/1987 Yokota et al. ..... 430/320
4,956,653 A * 9/1990 Braun ..... 347/64
5,272,026 A * 12/1993 Roland et al. ..... 430/18
5,296,333 A * 3/1994 Lamarre ..... 430/271.1
5,524,784 A 6/1996 Shiba et al. ..... 216/27
5,665,249 A * 9/1997 Burke et al. ..... 216/2
5,781,886 A * 7/1998 Tsujiuchi ..... 704/275
5,989,788 A * 11/1999 Bae et al. ..... 430/326
6,022,482 A * 2/2000 Chen et al. ..... 216/27
6,102,530 A * 8/2000 Kim et al. ..... 347/65
6,156,487 A * 12/2000 Jennison et al. ..... 430/316
6,242,344 B1 * 6/2001 Koh et al. ..... 438/638
6,322,202 B1 * 11/2001 Ahn ..... 347/65
6,406,134 B1 * 6/2002 Hu et al. ..... 347/65
6,475,921 B2 * 11/2002 Sandhu ..... 438/717
6,497,019 B1 * 12/2002 Yun ..... 29/25.35
6,550,893 B2 * 4/2003 Mrvos et al. ..... 347/44
6,644,789 B1 * 11/2003 Toews, III ..... 347/63
6,709,805 B1 * 3/2004 Patil ..... 430/320
6,846,068 B2 * 1/2005 Kim ..... 347/64
6,880,916 B2 * 4/2005 Kim ..... 347/47

(Continued)

FOREIGN PATENT DOCUMENTS

JP 04369546 A * 12/1992

*Primary Examiner*—Anita K Alanko
(74) *Attorney, Agent, or Firm*—Staas & Halsey LLP

(57) ABSTRACT

An ink-jet printhead and a method of manufacturing the same include a substrate on which a heater and a passivation layer protecting the heater are formed, a passage plate on which an ink chamber corresponding to the heater and an ink passage connected to the ink chamber are formed, and a nozzle plate in which an orifice corresponding to the ink chamber is formed. An exposure stop layer (ESL) that blocks passage of a photosensitive energy is formed inside the nozzle plate, and the nozzle plate and the passage plate are bonded with each other by the exposure stop layer (ESL).

15 Claims, 7 Drawing Sheets

U.S. PATENT DOCUMENTS 6,951,622 B2 * 10/2005 Chung et al. ..... 216/27
7,097,923 B2 * 8/2006 Webb et al. ..... 428/816
2002/0126162 A1 * 9/2002 Tomita et al. ..... 346/140.1
2002/0145644 A1 * 10/2002 Chen et al. ..... 347/47
2003/0058309 A1 * 3/2003 Haluzak et al. ..... 347/65
2003/0087199 A1 * 5/2003 Kim et al. ..... 430/320
2003/0203644 A1 * 10/2003 Coursey et al. ..... 438/761
2004/0023484 A1 * 2/2004 Chen et al. ..... 438/636
2004/0040929 A1 * 3/2004 Kim ..... 216/27

* cited by examiner

MONOLITHIC INK-JET PRINTHEAD AND METHOD OF MANUFACTURING THE SAME

CROSS-REFERENCE TO RELATED APPLICATIONS

This application claims the priority of Korean Patent Application No. 2002-50527, filed on Aug. 26, 2002, in the Korean Intellectual Property Office, the disclosure of which is incorporated herein in its entirety by reference.

BACKGROUND OF THE INVENTION

1. Field of the Invention

The present invention relates to a monolithic ink-jet printhead and a method of manufacturing the same, and more particularly, to a monolithic ink-jet printhead in which an ink chamber and a nozzle are effectively and easily formed, and a method of manufacturing the same.

2. Description of the Related Art

In general, ink-jet printheads eject ink droplets using an electro-thermal transducer (ink-jet type), which generates bubbles in ink using a heat source.

FIG. 1 is a schematic perspective view illustrating a structure of a conventional ink-jet printhead, and FIG. 2 is a schematic cross-sectional view of the ink-jet printhead shown in FIG. 1. Referring to FIGS. 1 and 2, the ink-jet printhead includes a manifold (not shown) to which ink is supplied, a substrate 1 on which a heater 12 and a passivation layer 11 protecting the heater 12 are formed, a passage plate 2 which includes an ink passage 22 and an ink chamber 21 formed on the substrate 1, and a nozzle plate 3 which is formed on the passage plate 2 and has an orifice 31 corresponding to the ink chamber 21.

In general, the passage plate 2 and the nozzle plate 3 are formed by a photolithography process using polyimide. In the conventional ink-jet printhead, the passage plate 2 and the nozzle plate 3 are formed of the same material, for example, the polyimide. The nozzle plate 3 may be easily detached from the passage plate 2 due to a weak adhering property of the polyimide.

In order to solve this problem, in a conventional method of manufacturing the ink-jet printhead, when the passage plate 2 and the nozzle plate 3 are formed of the polyimide as separate layers as described above, the passage plate 2 and the nozzle plate 3 are separately formed from the substrate 1 and are bonded on the substrate 1. In this method, due to several problems including a structural misalignment, the nozzle plate 3 cannot be attached to the substrate, such as a wafer, and the nozzle plate 3 should be attached to each chip which is separated from the wafer. Thus, this method results in low productivity.

Meanwhile, in conventional methods of manufacturing an ink-jet printhead disclosed in U.S. Pat. Nos. 5,524,784 and 6,022,482, a mold layer is used as a sacrificial layer so as to form an ink chamber and an ink passage.

In the conventional methods, the sacrificial layer is formed of a photoresist on a substrate to correspond to patterns of the ink chamber and the ink passage, polyimide is coated to a predetermined thickness on the sacrificial layer, and a passage plate and a nozzle plate are formed as a single body. Then, an orifice (nozzle) is formed in the nozzle plate, and the sacrificial layer is finally removed such that the ink chamber and the ink passage are formed below the nozzle plate. In the conventional methods of forming the ink passage and the orifice (nozzle) using the mold layer, the passage plate and the nozzle plate are formed of the polyimide to protect the mold layer. However, they cannot be hard-baked at a sufficient temperature since the mold layer is formed of the photoresist having a low heat-resistant property. As far as the mold layer exists, the passage plate or the nozzle plate formed of the polyimide cannot be hard-baked. Likewise, the non-hard-baked passage plate or nozzle plate is damaged by an etchant when the mold layer used to form the ink passage and the ink chamber is removed. In particular, a portion where the passage plate contacts the nozzle plate is etched, and an interface between the passage plate and the nozzle plate are damaged by the etchant and become unstable, thereby getting loose from the substrate.

SUMMARY OF THE INVENTION

The present invention provides a monolithic ink-jet printhead in which a nozzle plate and a passage plate are stably stacked, and a method of manufacturing the same.

The present invention further provides a monolithic ink-jet printhead in which an ink passage and an ink chamber are easily and effectively formed on a substrate, and a method of manufacturing the same.

Additional aspects and advantages of the invention will be set forth in part in the description which follows and, in part, will be obvious from the description, or may be learned by practice of the invention.

According to one aspect of the present invention, an ink-jet printhead includes a substrate on which a heater and a passivation layer protecting the heater are formed, a passage plate in which an ink chamber corresponding to the heater and an ink passage connected to the ink chamber are formed, and a nozzle plate in which an orifice corresponding to the ink chamber is formed. An exposure stop layer (ESL) blocking passage of a photosensitive energy is formed inside the nozzle plate or between the nozzle plate and the passage plate, and the nozzle plate and the passage plate bond by the exposure stop layer (ESL).

According to another aspect of the present invention, the passage plate and the nozzle plate are formed of polyimide. According to another aspect of the present invention, the ESL is formed of a material different from that of the passage plate and the nozzle plate. According to another aspect of the present invention, the ESL is formed of a metal.

According to another aspect of the present invention, a method of manufacturing an ink-jet printhead includes preparing a substrate on which a heater and a passivation layer protecting the heater, coating a first photosensitive photoresist on the substrate to form a passage plate, exposing the passage plate to light through a reticle having a predetermined pattern to optically determine a portion of the passage plate to be removed from the passage plate using a predetermined etchant so as to form an ink chamber corresponding to the heater and an ink passage connected to the ink chamber and to determine a remaining portion of the passage plate to form a wall defining the ink chamber, forming an exposure stop layer (ESL) that intercepts ultraviolet rays, on the passage plate to a predetermined thickness, coating a second photoresist on the exposure stop layer (ESL) to a predetermined thickness to form a nozzle plate, forming an orifice corresponding to the ink chamber in the nozzle plate by a photolithography process, and removing a part of the exposure stop layer (ESL) corresponding to the orifice and a region of the passage plate corresponding to the portion of the passage plate to be removed from the passage plate so as to form the ink chamber and the ink passage.

The passage plate and the nozzle plate are formed of either a negative-type photoresist or a negative-type polyimide.

According to another aspect of the present invention, the exposure stop layer (ESL) is formed of a photoresist different from that of the passage plate and the nozzle plate. According to another aspect of the present invention, the exposure stop layer (ESL) is formed of metal. It is possible that the passage plate and the nozzle plate are formed of either the negative-type photoresist or the negative-type polyimide. In particular, after the part of the exposure stop layer (ESL) has been removed, the method further includes performing a flood exposure process on a top surface of the nozzle plate and hard-baking the passage plate and the nozzle plate.

Meanwhile, the method further includes forming an ink supply hole, through which ink is supplied to a top side of the substrate from a bottom side of the substrate. The method further includes forming an ink supply channel, which supplies the ink to the ink chamber through the ink passage and the ink supply hole and has a bottom in which an ink supply hole connected to the ink passage is to be formed, on the bottom surface of the substrate to a predetermined depth.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
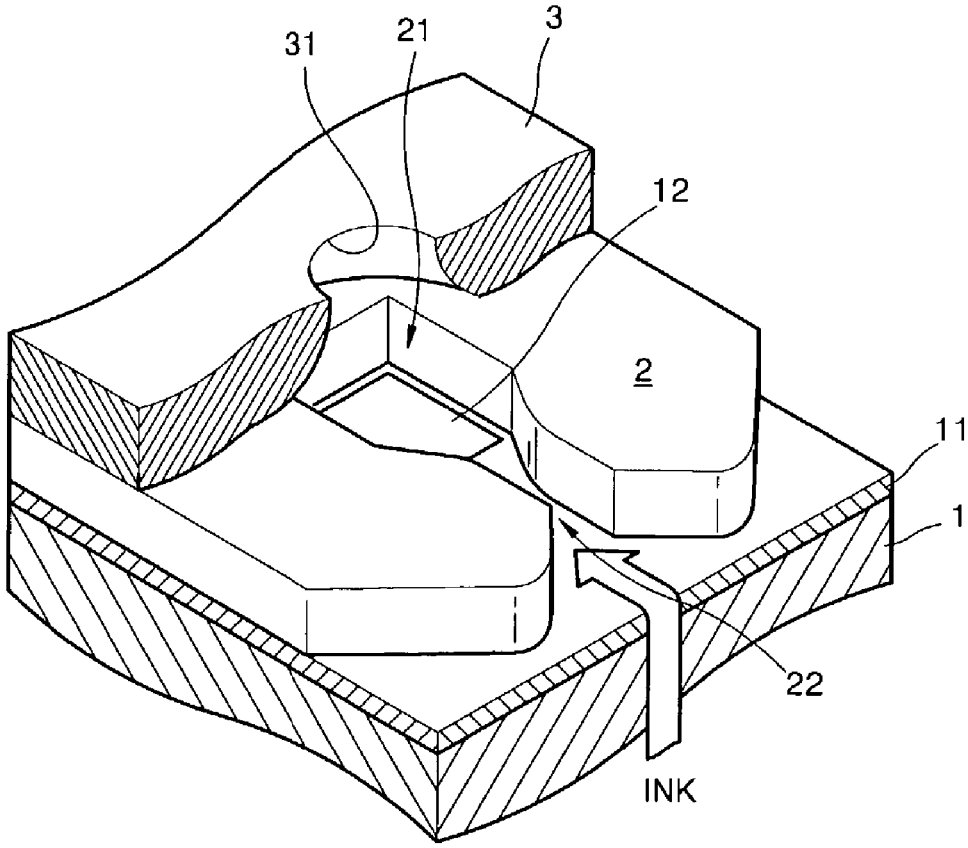
FIG. 1 (PRIOR ART)
FIG. 1 is a schematic perspective view illustrating a structure of a conventional ink-jet printhead.
Figure 2:
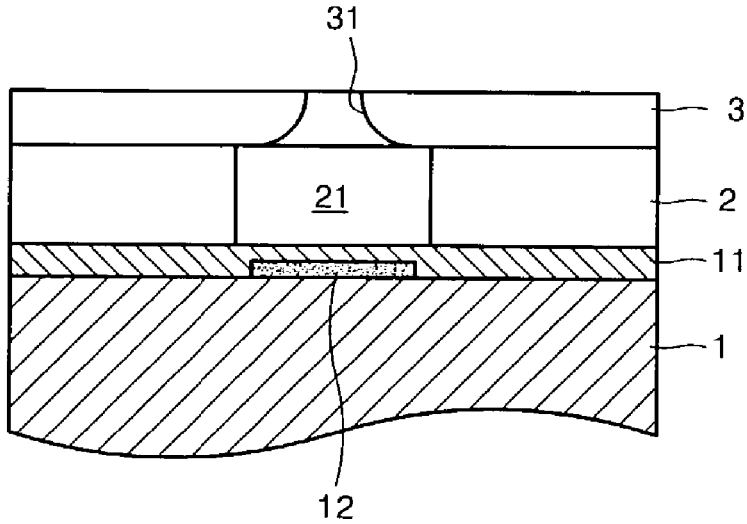
FIG. 2 (PRIOR ART)
FIG. 2 is a schematic cross-sectional view of the ink-jet printhead shown in FIG. 1.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Hereinafter, an ink-jet printhead and a method of manufacturing the same according to an embodiment of the present invention will be described in detail with reference to the accompanying drawings.

Figure 3:
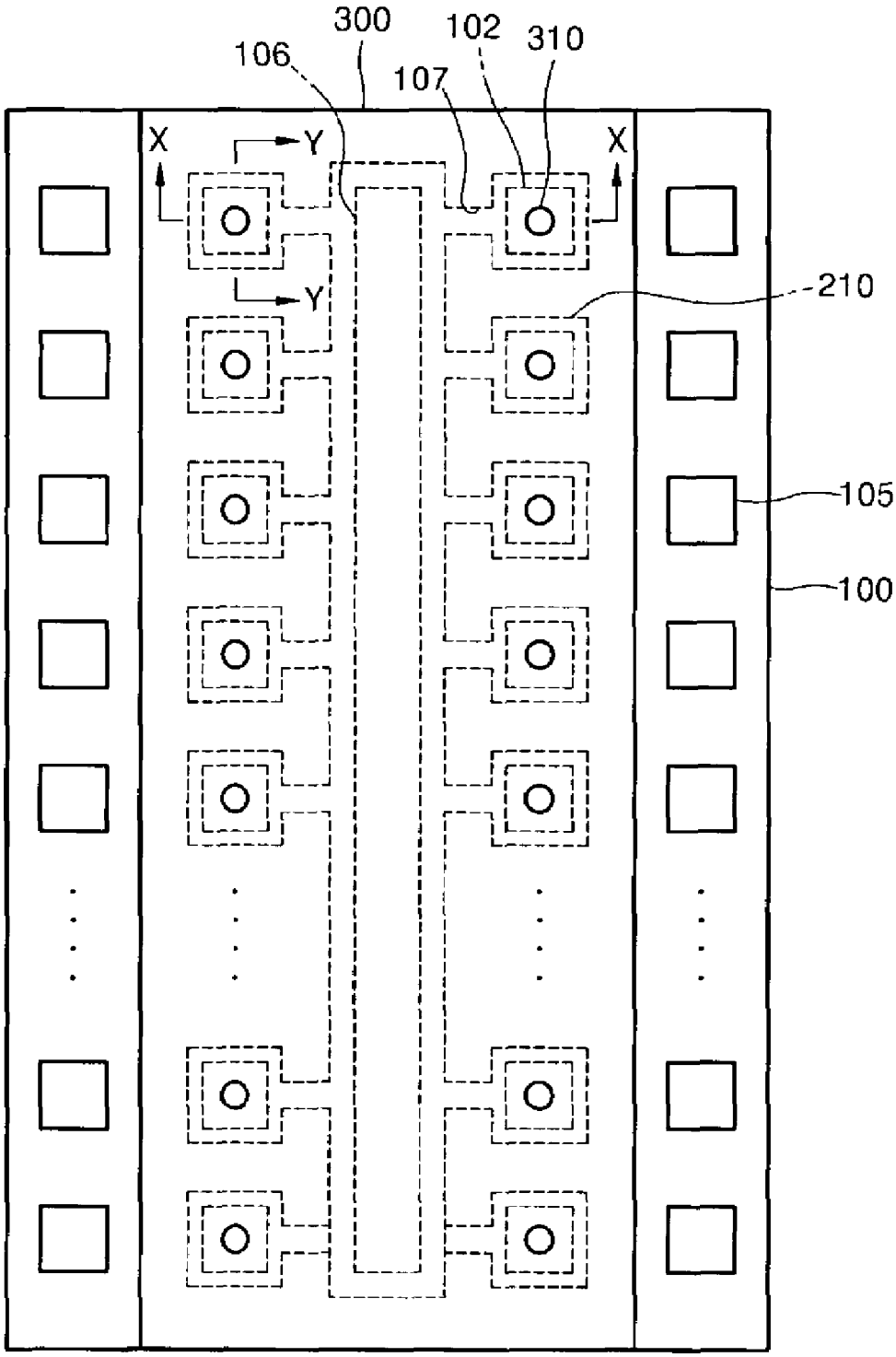
FIG. 3 is a schematic plane view illustrating an ink-jet printhead according to an embodiment of the present invention.
Figure 4:
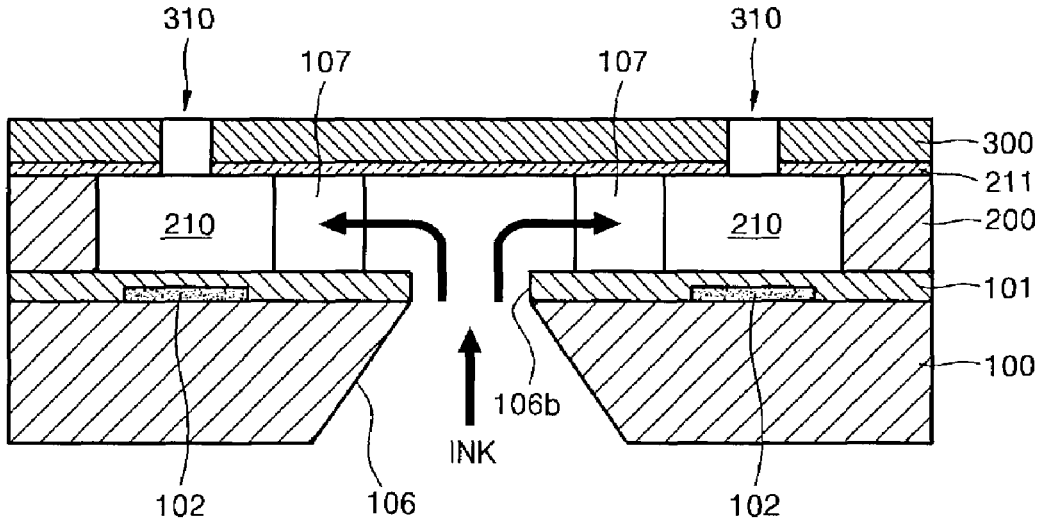
FIG. 4 is a cross-sectional view taken along a line X-X of FIG. 3.
Figure 5:
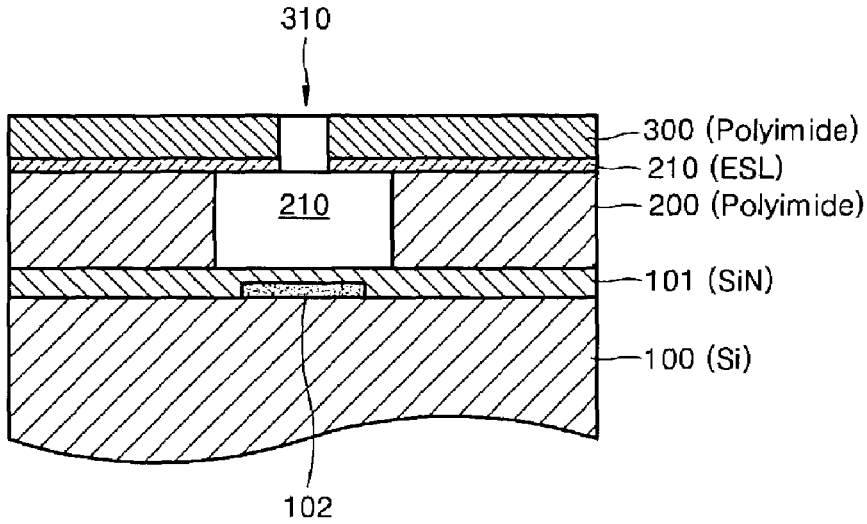
FIG. 5 is a cross-sectional view taken along a line Y-Y of FIG. 3.

FIG. 3 is a schematic plane view illustrating an inkjet printhead according to an embodiment of the present invention, FIG. 4 is a cross-sectional view taken along a line X-X of FIG. 3, and FIG. 5 is a cross-sectional view taken along a line Y-Y of FIG. 3.

As shown in FIG. 3, a plurality of pads 105 to be electrically connected to an internal circuit of the ink-jet printhead are arranged in a line along both long sides of a substrate 100 of the ink-jet printhead. The pads 105 may be formed along short sides of the substrate 100 according to design specifications. A nozzle plate 300 is placed between both edges (long or short sides) of the substrate 100 on which the pads 105 are formed. As shown in FIGS. 4 and 5, an orifice 310 through which ink droplets are ejected is formed in the nozzle plate 300, and a heater 102 formed on a top surface of the substrate 100 is placed on a bottom of an ink chamber 210 below the nozzle plate 300. The heater 102 is protected by a passivation layer 101. The heater 102 is electrically connected to the pads 105. As shown in FIGS. 3 through 5, the heater 102 is to be formed in the ink chamber 210 determined (defined) by a passage plate 200. The ink chamber 210 is connected to an ink supply channel 106 through an ink supply hole 106*b* formed in the substrate 100 by an ink passage 107. In the present embodiment, the nozzle plate 300 and the passage plate 200 are formed of a photoresist, in particular, polyimide.

Referring to FIGS. 4 and 5, an exposure stop layer (ESL) 211, which is a feature of the present invention, is formed on a bottom surface of the nozzle plate 300. The ESL 211 may be formed of a dyed photoresist so as to intercept metals, such as Ni and Ti, or an exposure energy, such as ultraviolet rays and an X-ray. Here, the ESL 211 reflects and/or absorbs incident ultraviolet rays or X-ray, thereby preventing the exposure energy from transmitting to the passage plate 200 from an outside of the nozzle plate 300. Besides the above-described exposure stop function, the ESL 211 improves an adhesive force between the nozzle plate 300 and the passage plate 200 formed of a material, such as the polyimide, having a weak adhering property. On the other hand, the ESL 211 plays a very important role in manufacturing the passage plate 200 and the nozzle plate 300. A method of manufacturing the ink-jet printhead using another function of the ESL 211 in manufacturing the passage plate 200 and the nozzle plate 300, will be described in detail with reference to the accompanying drawings.

Hereinafter, well-known techniques, in particular, well-known techniques for manufacturing portions of the ink-jet printhead will not be specifically described.

FIGS. 6A through 6H are process views illustrating a method of manufacturing the inkjet printhead, and the process views correspond to a cross-section taken along line X-X of FIG. 3.

Figure 6A:
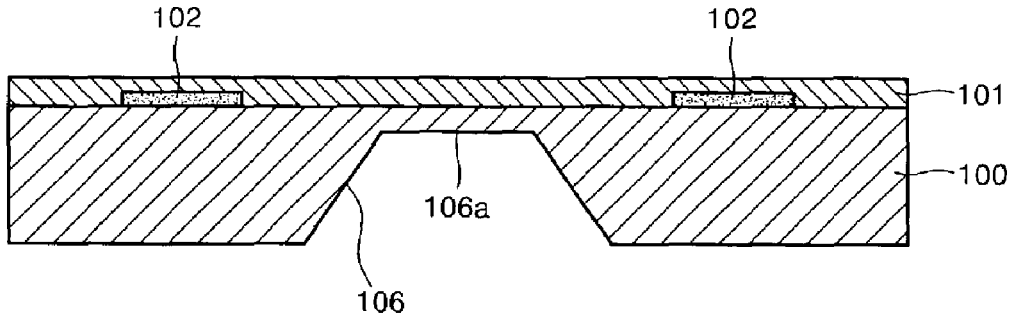
FIGS. 6A through 6H are process views illustrating a method of manufacturing the ink-jet printhead shown in FIGS. 3 through 5.

As shown in FIG. 6A, the substrate 100, such as a silicon wafer or a single monolithic silicon wafer, on which an underlayer including the heater 102 and the passivation layer 101 made of SiN to protect the heater 102 is formed, is prepared. This operation is performed on the wafer and accompanies forming a material for use in the heater 102, patterning the formed material to form the heater 102, and depositing the passivation layer 101 on the heater 102 and the substrate 100. The ink supply channel 106 supplying ink is formed on a bottom of the substrate 100. In this case, a bottom 106*a* of the ink supply channel 106 is placed between the heaters 102 installed on the substrate 100 and is perforated by a subsequent process. Here, the ink supply channel 106 may be not formed in the above-described operation but may be formed after the nozzle plate 300 is formed.

Figure 6B:
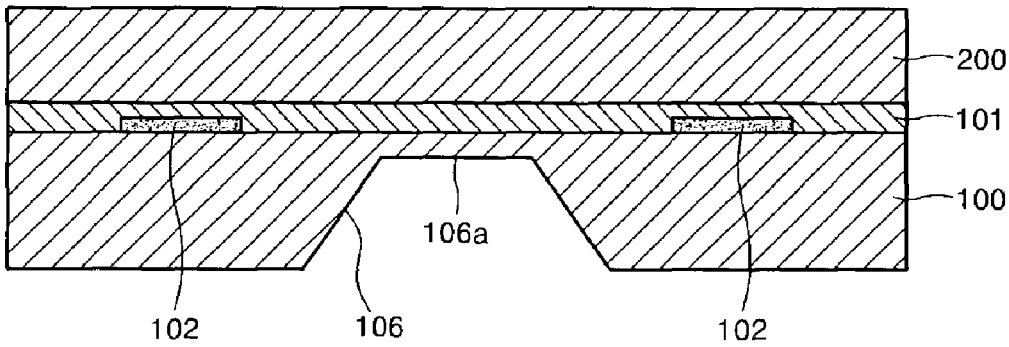

As shown in FIG. 6B, the photoresist, for example, the polyimide, is coated to a thickness of several microns, for example, to a thickness of 30 microns, on an entire surface of the passivation layer 101 formed on the substrate 100 to form the passage plate 200. Here, a positive-type or negative-type photoresist or polyimide may be used as the passage plate 200.

Figure 6C:
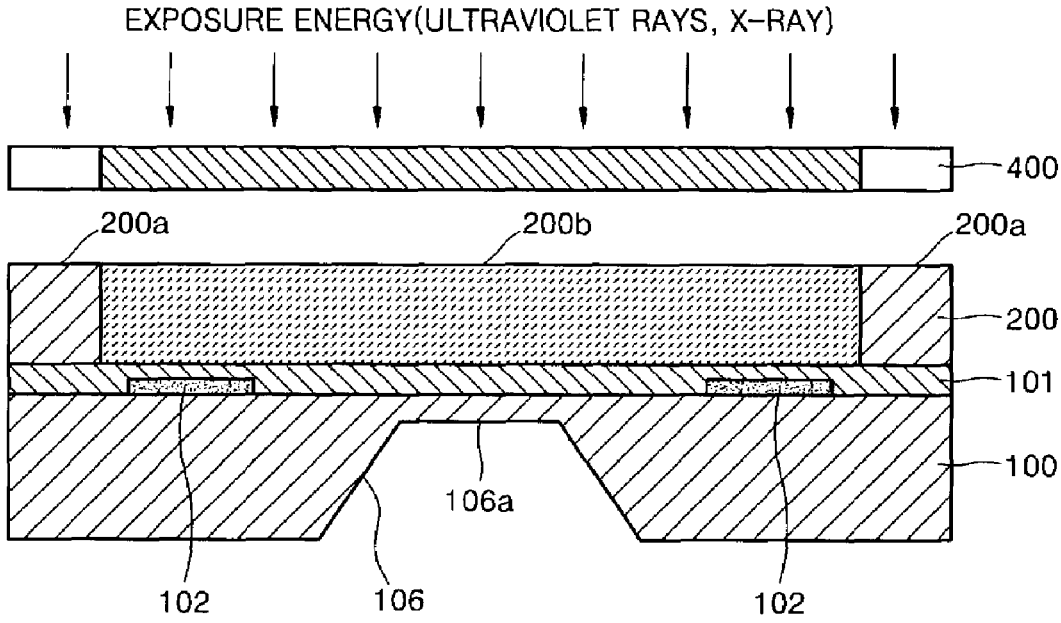

As shown in FIG. 6C, the passage plate 200 is exposed to the exposure energy using a predetermined pattern. In this case, an exposure process is performed using a reticle 400 such as a metal mask. The reticle 400 has a pattern used to optically determine (define) a portion 200*b*, which is to be removed from the passage plate 200 using a predetermined etchant so as to form the ink chamber 210 corresponding to the heater 102 and the ink passage 107 connected to the ink chamber 210, and to optically determine (define) a remaining portion 200*a* of the passage plate 200 to form a wall defining the ink chamber 210. In this embodiment, the passage plate 200 is formed of the negative-type polyimide. Here, when the passage plate 200 is formed of the negative-type photoresist or polyimide, the remaining portion 200*a* is exposed. Contrarily, when the passage plate 200 is formed of the positive-type photoresist or polyimide, the portion 200*b* is exposed.

Figure 6D:
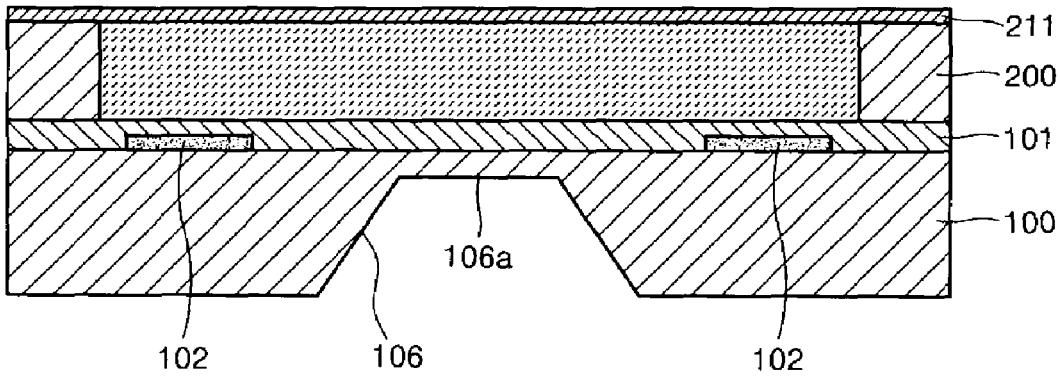

As shown in FIG. 6D, the exposure stop layer (ESL) 211, which intercepts and absorbs a photosensitive energy (exposure energy), such as the ultraviolet rays or the X-ray, and prevents the photosensitive energy from transmitting to the passage plate 200, is formed to a predetermined thickness on the passage plate 200. A dyed photoresist, used to intercept and absorb the metals, such as Ni and Ti, or the photosensitive energy, may be used as the ESL 211. When the ESL 211 is formed of the photoresist, it is possible that the ESL 211 is formed of a material different from that of the passage plate 200.

Figure 6E:
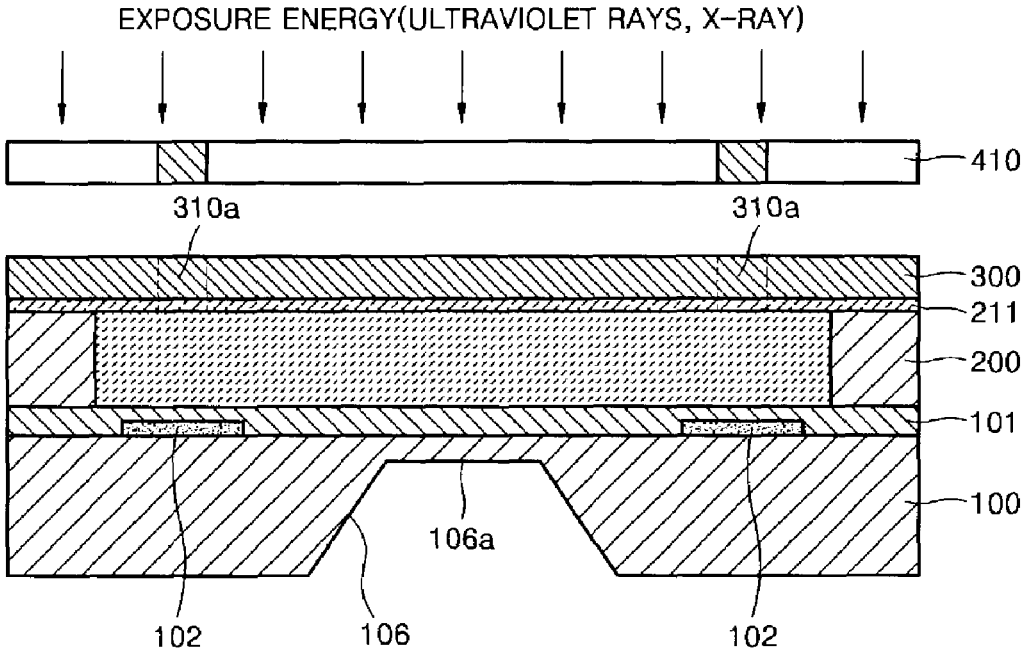

As shown in FIG. 6E, the nozzle plate 300 is formed on a top surface of the ESL 211 by spin-coating the photoresist or the polyimide to a predetermined thickness. Subsequently, the nozzle plate 300 is exposed using a predetermined pattern. In this case, a second reticle 410, such as the metal mask, having a pattern corresponding to a shape of the orifice 310 formed on the nozzle plate 300, is used during another exposure process. In the exposure process, a light energy is intercepted by the ESL 211 on the passage plate 200 below the nozzle plate 300, and thus, the passage plate 200 is not exposed. FIG. 6E shows a case where the negative-type polyimide is used and a portion excluding an orifice-forming portion 310*a* is exposed.

Figure 6F:
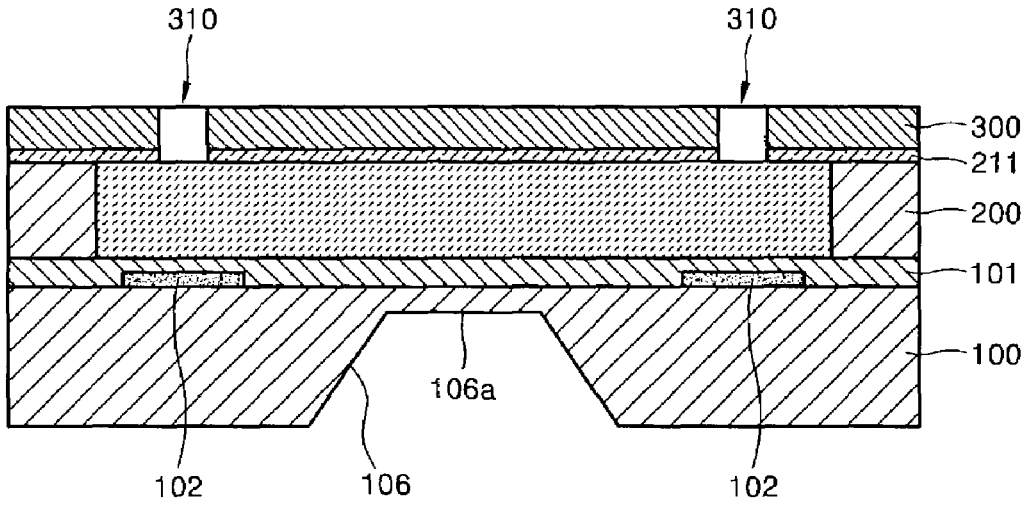

As shown in FIG. 6F, the orifice-forming portion 310*a* is etched to form the orifice 310. In this case, when the ESL 211 is formed of the polyimide or the photoresist, a part of the ESL 211 that blocks an internal side of the orifice 310, is removed. Thus, a surface of the portion 200*b* of the passage plate 200 is exposed through a lower portion of the orifice 310. Also, when the ESL 211 is formed of metal, a part of the ESL 211 that blocks the orifice 310, is removed by a separate etch process using the orifice 310.

Figure 6G:
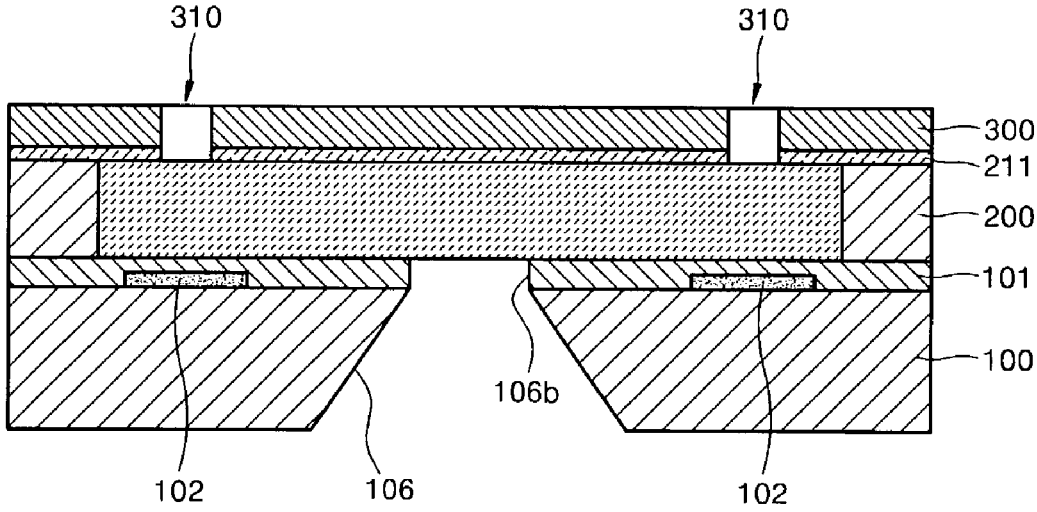

As shown in FIG. 6G, the ink supply hole 106*b* which penetrates the substrate 100, is formed using an $XeF_2$ dry etch process by removing the bottom 106*a* of the ink supply channel 106. Thus, an ink supply route through which ink is supplied to a top surface of the substrate 100 from a bottom surface of the substrate 100 is formed on the substrate 100. In this case, when the ink supply channel 106 is not formed on the bottom surface of the substrate 100 in the operation shown in FIG. 6A, the ink supply channel 106 and the ink supply hole 106*b* are formed together on the substrate 100.

Figure 6H:
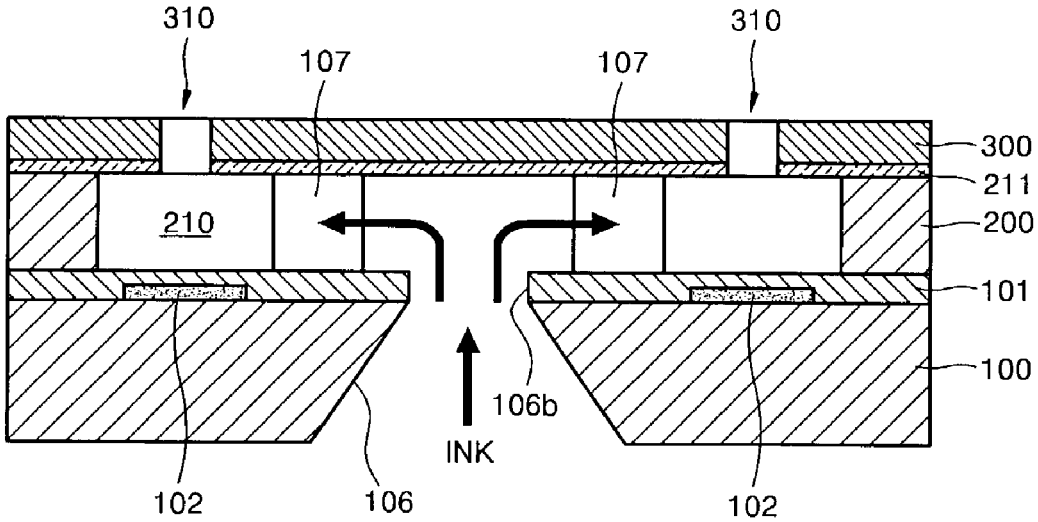

As shown in FIG. 6H, the portion 200*b* to be removed from the passage plate 200 is removed through the orifice 310 and the ink supply channel 106. In this case, an etchant is supplied through the orifice 310 and the ink supply channel 106, and the ink chamber 210 and the ink passage 107 are formed in the passage plate 200 through an etch process.

After the ink chamber 210 and the ink passage 107 are formed in the passage plate 200, a flood exposure process is performed on the top surface of the substrate 100 such that the passage plate 200 and the nozzle plate 300 are more light-cured. Subsequently, the passage plate 200 and the nozzle plate 300 are hard-baked, thereby manufacturing a desired ink-jet printhead. Here, the flood exposure process is used when light-cured, that is, the negative-type photoresist and polyimide are used as the nozzle plate 300 and the passage plate 200. Likewise, it is possible that the passage plate 200 and the nozzle plate 300 are formed of a negative-type material.

As described above, according to the present invention, the passage plate and the nozzle plate can be formed by a simpler process than the related art while being maintained at a separate body. In particular, a region for the passage plate itself is optically determined such that an additional mold layer for obtaining the ink chamber and the ink passage like in the related art is not required. In addition, the exposure stop layer used in manufacturing the nozzle plate and the passage plate prevents exposure of the passage plate, remains in a structure of the ink-jet printhead, and helps a stable adhesion between the passage plate and the nozzle plate.

While this invention has been particularly shown and described with reference to preferred embodiments thereof, it will be understood by those skilled in the art that various changes in form and details may be made therein without departing from the spirit and scope thereof as defined by the appended claims and their equivalents.

What is claimed is:

1. A method of manufacturing an ink-jet printhead, the method comprising:

forming a heater and a passivation layer protecting the heater on a substrate;

coating a first photosensitive photoresist on the substrate to form a passage plate;

exposing the passage plate to light using a reticle having a predetermined pattern to optically determine a portion of the passage plate to be removed from the passage plate using a predetermined etchant so as to form an ink chamber corresponding to the heater and an ink passage connected to the ink chamber, and to determine a remaining portion of the passage plate;

forming an exposure stop layer (ESL) that intercepts ultraviolet rays, on the portion of the passage plate to be removed from the passage plate and on the remaining portion of the passage plate where the exposure stop layer is formed to a predetermined thickness;

coating a second photoresist on the exposure stop layer (ESL) to a predetermined thickness to form a nozzle plate such that the exposure stop layer is formed between the second photoresist, and the portion of the passage plate to be removed and the remaining portion of the passage plate;

forming an orifice corresponding to the ink chamber in the nozzle plate by a photolithography process; and removing a part of the exposure stop layer (ESL) corresponding to the orifice and a region of the passage plate selected as the portion to be removed from the passage plate so as to form the ink chamber and the ink passage.

2. The method of claim 1, wherein the exposure stop layer (ESL) is formed of a photoresist different from that of the passage plate and the nozzle plate.

3. The method of claim 1, wherein the exposure stop layer (ESL) is formed of metal.

4. The method of claim 3, wherein the passage plate and the nozzle plate are formed of either a negative-type photoresist or a negative-type polyimide.

5. The method of claim 4, wherein the removing of the part of the exposure stop layer (ESL) and the region of the passage plate comprises:

performing a flood exposure process on a top surface of the nozzle plate; and hard-baking the passage plate and the nozzle plate.

6. The method of claim 1, further comprising:

forming an ink supply hole through which ink is supplied to a bottom surface of the substrate.

7. The method of claim 1, further comprising:

forming an ink supply channel, which supplies ink to the ink chamber through the ink passage and has an ink supply hole formed on the passivation layer to be connected to the ink passage, on a bottom surface of the substrate to a predetermined depth.

8. The method of claim 1, wherein the passage plate and the nozzle plate are formed of either a negative-type photoresist or a negative-type polyimide.

9. The method of claim 8, wherein the exposure stop layer (ESL) is formed of the photoresist different from that of the passage plate and the nozzle plate.

10. The method of claim 8, wherein the exposure stop layer (ESL) is formed of a metal.

11. The method of claim 10, wherein the passage plate and the nozzle plate are formed of either a negative-type photoresist or a negative-type polyimide.

12. The method of claim 11, wherein the removing of the part of the exposure stop layer (ESL) and the region of the passage plate comprises:

performing a flood exposure process on a top surface of the nozzle plate; and hard-baking the passage plate and the nozzle plate.

13. The method of claim 8, further comprising:

forming an ink supply hole through which ink is supplied to a bottom surface of the substrate.

14. The method of claim 8, further comprising:

forming an ink supply channel, which supplies ink to the ink chamber through the ink passage and has a bottom in which an ink supply hole connected to the ink passage is to be formed, on the bottom surface of the substrate to a predetermined depth.

15. The method of claim 1, further comprising:

removing a bottom of an ink supply channel formed on a bottom of the substrate corresponding with a part of the portion of the passage plate to be removed.

* * * * *